United States Patent [19]

Boyer

[11] 4,125,366

[45] Nov. 14, 1978

[54] INFRA-RED HEATED SPRAY PAINT BOOTH

[76] Inventor: Ivan M. Boyer, P.O. Box 670, Spearfish, S. Dak. 57783

[21] Appl. No.: 788,981

[22] Filed: Apr. 19, 1977

[51] Int. Cl.[2] ..... F26B 3/30

[52] U.S. Cl. ..... 432/209; 34/4

[58] Field of Search ..... 34/4; 126/91 A, 92 B, 126/92 C; 118/642; 432/209

[56] References Cited

U.S. PATENT DOCUMENTS 4,043,048 8/1977 Veater ..... 34/4

FOREIGN PATENT DOCUMENTS 213,365 2/1958 Australia ..... 126/92 B 2,229,763 1/1974 Fed. Rep. of Germany ..... 126/91 A

*Primary Examiner*—Martin P. Schwadron

*Assistant Examiner*—Richard Gerard

*Attorney, Agent, or Firm*—Beall & Jeffery

[57] ABSTRACT

The infra-red heated spray paint booth has positioned in the roof thereof an infra-red heater which extends the length of the booth. The heater includes a black radiant pipe to which is supplied high temperature combustion gases at one end thereof while the other end has a vacuum pump to draw the combustion gases through the pipe. The pipe is comprised of three spaced sections, each of which is mounted adjacent the reflective surfaces of a reflector unit mounted on the roof of the booth. The reflector units cooperate with glass infra-red energy transmitting members to provide enclosed zones, with the black radiant pipe section positioned between each glass member and a reflector unit. The black radiant pipe emits infra-red rays which are focused in part by the reflector and pass through the glass infra-red energy transmitting member to impinge upon a freshly painted workpiece, for example, an automobile, in the paint booth below.

12 Claims, 4 Drawing Figures

INFRA-RED HEATED SPRAY PAINT BOOTH

BACKGROUND OF THE INVENTION

The present invention relates to a radiant infra-red heated spray paint booth, the purpose of which is to more efficiently dry the objects being painted. The booth is particularly well suited for painting automotive vehicles but it will be understood, and will become apparent as the description proceeds, that virtually any object can be painted and dried in the booth.

Ever since the introduction of mass production techniques in respect to the rapid drying of freshly painted surfaces, the painting industry, on both large and small scale, has constantly sought ways to improve the rate and quality of paint drying operations. Large manufacturers frequently can justify the space requirements and consequent cost necessary for separate painting and paint drying areas. In those situations where the paint drying is performed to the exclusion of painting, the use of direct radiant heat accompanied by either heated forced air or natural convection has been employed. Under these circumstances, the operators of the drying apparatus can carefully control the flow of heated air around and over the paint surface to be dried. The cost of providing equipment to furnish both heated air as well as direct radiant heat bear negatively upon the economy of this approach. At the present time with energy costs escalating the use of both direct radiant heat and forced convection heat becomes economically undesirable.

It is well known that the rate of heat transfer is much greater for radiation heating than for any other type of heating, because the heat transfer by radiation is direct, immediate and constant throughout the process. With convection or conduction heating, the heat capacity of the medium enters is often a detrimental factor. The thermal capacity of air is relatively small, and it therefore takes considerable time to transfer a large amount of heat from the source to the air and from the air to the workpiece. It is obvious therefore that direct heat transfer is a more economical method of heat transfer than by convection.

One example of the combined methods of connective and conductive heat transfer is shown in U.S. Pat. No. 3,151,950 which discloses direct radiant heating while simultaneously introducing forced convection heating to a painted surface to be dried. This patented system represents a most complex and costly approach to drying paint.

Direct heat transfer by radiation is frequently accomplished by a bank of infra-red filament lamp sources. Most of these banks of infra-red lamps contain dozens if not hundreds of individual lamps due to the fact that the lamp filament, which emits electromagnetic energy in the wave length of infra-red, is very small. The rate of emission is an important factor in determining the rate of absorption in a paint absorbing medium, i.e. the rate of heating depends on the rate of emission. The higher the temperature, the higher are the relative peak intensitites of the respective radiating surfaces where the two emitters are of the same surface area. Each lamp in the bank has a small filament and therefore a small emitter surface. Accordingly, a multitude of lamps in close proximity are required to provide an evenly distributed application of heat to the painted surface to be dried. The maintenance costs and lamp replacement efforts required of these arrangements detract from their economy and usefulness. Additionally, the lamp breakage is a safety hazard, not to mention hot spots that are created by the physical appliances that hold the lamps.

U.S. Pat. No. 2,498,339 illustrates the use of multiple heating lamps in an upper chamber of a two chamber combination spray paint and baking oven. The oven employs heat lamps to dry or bake the freshly painted auto finish, and the auto is first painted in the lower chamber and thereafter lifted into the baking oven.

The desirability of employing energy sources other than electricity to cause the emission of infra-red energy have led others to provide a radiant burner with the combustion products of air and gas. Referring to U.S. Pat. No. 3,299,938, the combustion products pass through a porous structure that in turn becomes an emitter of infra-red energy. The gas fired radiant heater introduces the combustion product directly into the zone to be heated along with the infra-red energy. Introduction of such high temperature combustion products into a paint filled atmosphere could result in an explosive situation.

In view of the above noted disadvantages in the art, efforts were previously made by applicant to provide a satisfactory and efficient solution to the problem of paint drying in booths of the type described. These efforts, however, were not entirely successful since glass panels, forming part of a radiant heater assembly, could not be obtained which would not shatter after relatively short periods of use. The temperature in the vicinity of the radiant pipe is approximately 900° F. and glass panels used prior to the present invention simply do not withstand such temperatures and shatter after a relatively short period of time.

SUMMARY OF THE INVENTION

It is therefore a primary object of this invention to provide a new and improved infra-red radiant heater wherein a black radiant pipe provides an infra-red emitting surface for transmission of infra-red energy through a glass panel constructed to continuously transmit energy without shattering.

Another object of this invention is to provide such a radiant heater in combination with a single booth or compartment so as to provide an environment suitable to either painting or drying a workpiece without physically moving the object.

Another object of this invention is to provide such an infra-red heater that employs combustion gases as a source of energy to activate a black pipe emitter which in turn uniformally transmits infra-red energy through the glass transmitting member to a workpiece to be dried or baked, all without contamination of the atmosphere surrounding the workpiece or requiring the introduction of heated convective gases to the workpiece area.

Yet another object of the invention is to provide an infra-red heated spray paint booth wherein a single infra-red heat source, in three transversely spaced branches or sections, is provided over substantially the entire length of the booth, with each branch having associated therewith in a sealed relation a glass infra-red transmitting member and a reflector for reflecting the radiant energy downwardly through the glass into the booth. Vacuum exhaust systems are additionally provided for exhausting the spent combustion gases from the radiant pipe and the paint fumes from the interior of the booth. In accordance with the invention, the workpiece, e.g. an automobile, is spray painted and simultaneously dried by the radiant heater. Energy savings resulting from the present invention are as high as 50%, and the heater fully meets all federal and state safety and health codes.

Other objects and advantages of the present invention will become apparent from the following description, in particular reference to the accompanying drawings.

BRIEF DESCRIPTION OF THE APPLICATION DRAWINGS

DETAILED DESCRIPTION OF THE PREFERRED EMBODIMENT

Figure 1:
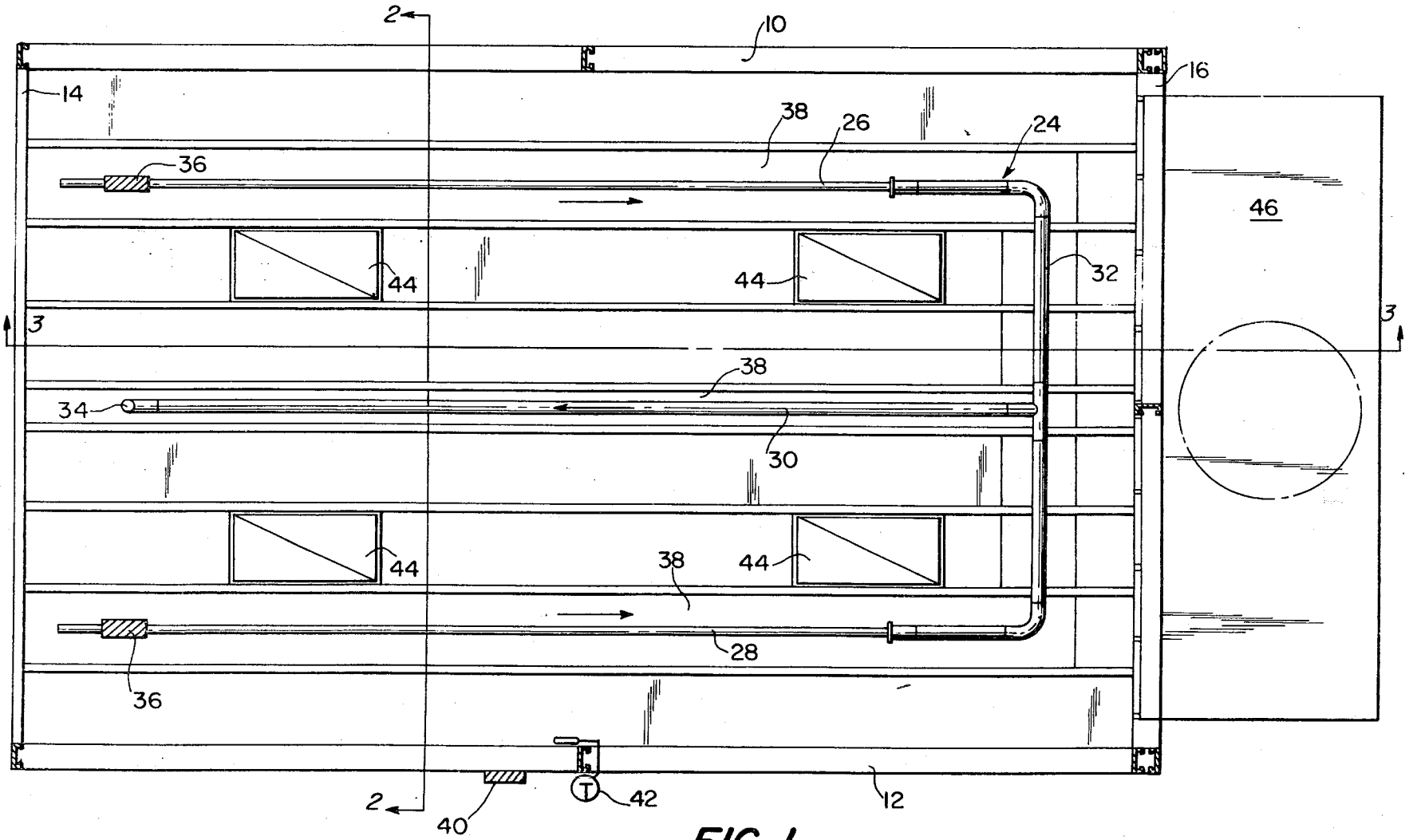
FIG. 1 is a top plan view of the infra-red heated spray paint booth of the present invention.
Figure 2:
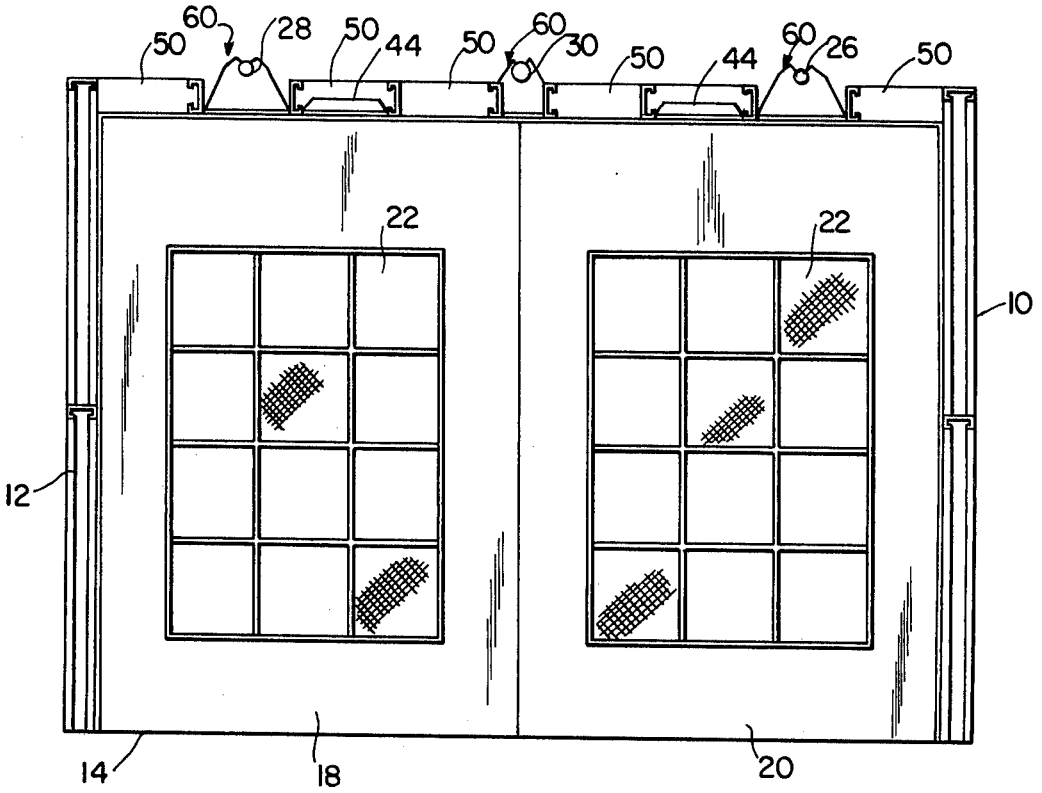
FIG. 2 is a cross-sectional view taken along the line 2—2 in FIG. 1.

Referring to the application drawings in detail, wherein like parts are indicated by like reference numbers, FIG. 1 is a top plan view of the apparatus, with certain portions of the radiant heating assembly being omitted to show the general layout of the entire apparatus. The booth comprises side walls 10 and 12 which can be fabricated in any suitable manner, and end walls 14 and 16. The end wall 16 can likewise be fabricated and the front wall 14, referring to FIG. 2, is preferably in the form of doors 18 and 20 which can be opened to permit objects to be painted to be moved inwardly and outwardly of the booth. The interior surfaces of the walls are preferably of metal to increase the reflection of the radiation energy. The doors 18 and 20 are provided with windowpanes commonly designated at 22 which are constructed to filter the radiated energy transmitted therethrough. The doors 18 and 20 can be hinged or otherwise mounted to permit convenient opening and closing of the same.

Reverting back to FIG. 1, a black radiant pipe assembly generally indicated at 24 is mounted above the booth, with the assembly including sections or branches 26, 28 and 30, with the branches 26 and 28 being outermost and connected to the return branch 30 through a header 32. The terminal portion 34 of the branch 30 is connected to a vacuum pump (not shown) which is mounted above the booth for exhausting the spent combustion gases.

Burner units commonly designated at 36 are mounted in the branches 26 and 28 of the pipe assembly, with the burner units being commercially available and providing an input of approximately 40,000 B.T.U. per hour input for each burner. It will be understood that gas and air are supplied to each burner unit and that the combustible gases travel through pipe branches 26 and 28 to the return branch 30 and eventually to the vacuum pump. Mounted below and spaced from each pipe branch is a tempered glass member commonly designated at 38 the details of which will be described in more detail hereinbelow when particular reference is made to FIG. 4.

Shown diagrametically in FIG. 1 is a vacuum pump control panel 40 and a thermostat 42 for controlling the temperature within the booth. Light fixtures commonly designated at 44 are schematically shown in FIG. 1 and are positioned in the roof sections between the branches 26, 28, 30 of the black radiant pipe assembly 24, and function in the usual manner to provide light to the interior of the booth.

Figure 3:
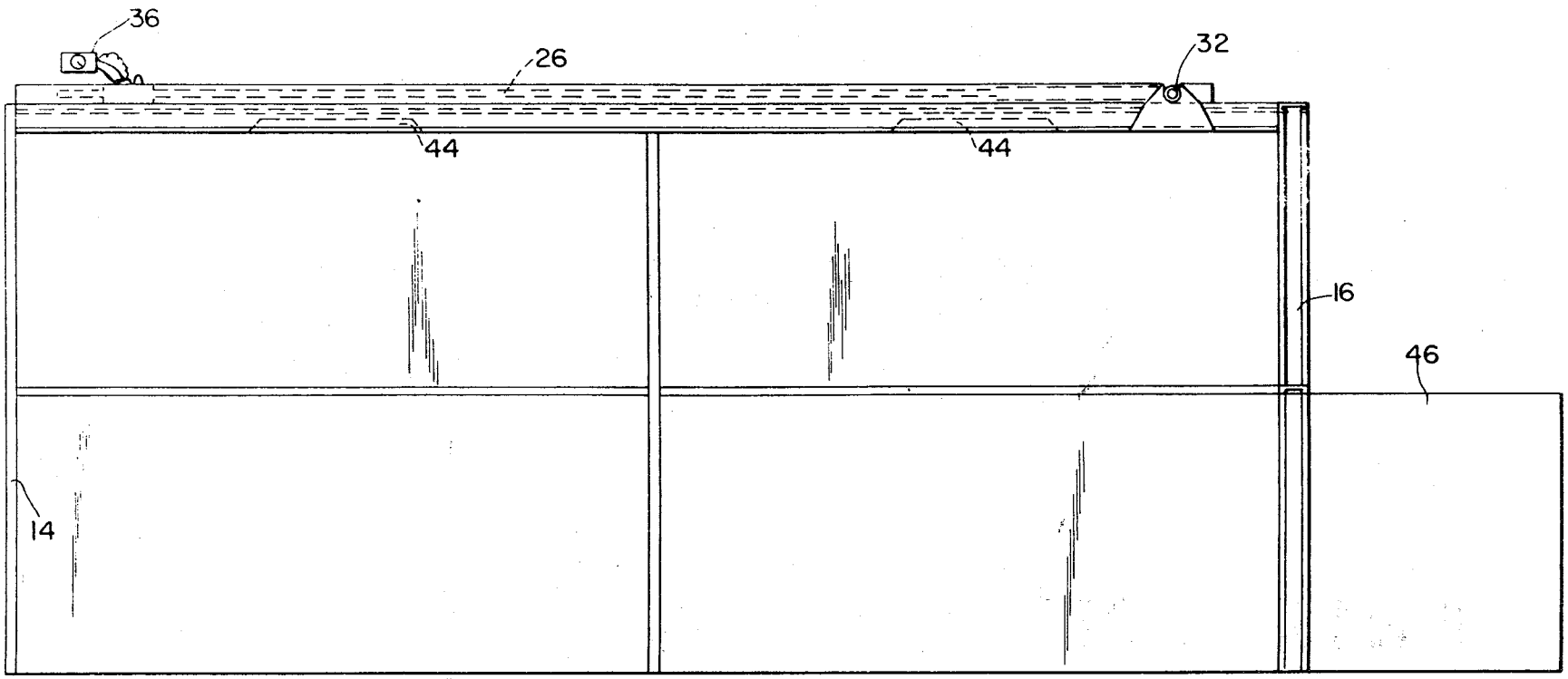
FIG. 3 is a cross-sectional view taken along the line 3—3 in FIG. 1, and, FIG. 4 is an enlarged sectional view through one of the radiant heater assemblies.

A plenum 46 is positioned at one end of the booth (see FIG. 3) for the purpose of exhausting paint fumes from the interior of the booth, and the plenum 46 preferably communicates with the interior of the booth through a series of air filters (not shown). Fresh air can be admitted to the booth in any suitable manner.

Figure 4:
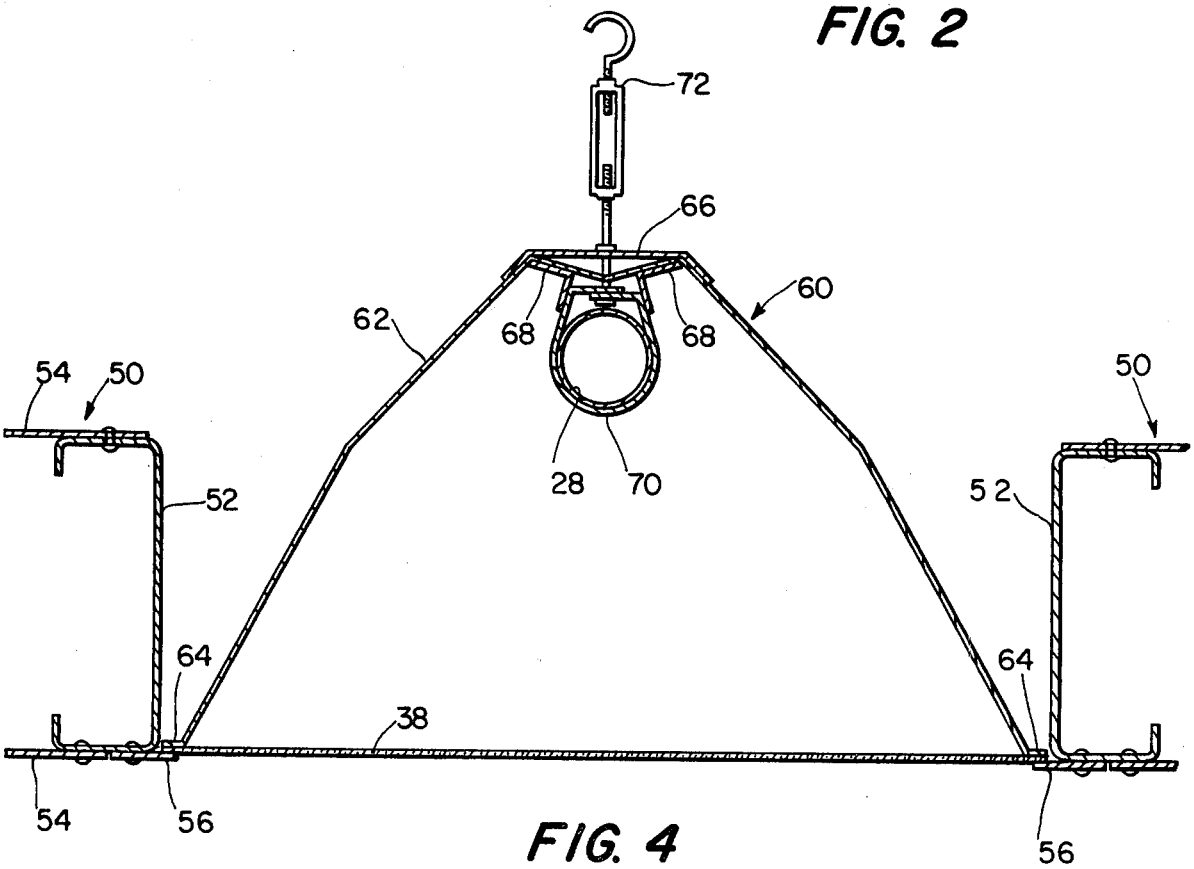

Referring to FIGS. 2 and 4, as previously noted the roof of the booth is fabricated and comprises longitudinally extending and transversely spaced roof sections which are commonly designated at 50. As shown in FIG. 4, channel members 52 extend longitudinally of the booth and flat sheet metal members commonly designated at 54 are secured thereto by riveting or the like. Each roof section includes a longitudinally extending bottom flange member 56 to support radiant heating assemblies generally indicated at 60 positioned between adjoining roof sections. As can be seen in FIG. 2, there are two substantially identical radiant heating assemblies 60 which include the pipe branches 26 and 28, and a central radiant heating assembly 60 in which is positioned the return radiant pipe branch 30.

Each radiant heating assembly 60 includes a reflector 62, which is one piece in the form shown and which is formed with lateral side flanges commonly designated at 64 which overlie and are supported by the roof flanges 56. The reflector 62 is constructed of a reflective material at least on the inner surface thereof and is generally of inverted V-shape in cross section, with the uppermost portion of the reflector extending under and being secured to a stabilizing member 66. Secured to the reflector 62 in generally the same region are pipe and reflector support members 68 which include generally cylindrical pipe support sections 70 at the ends of the assembly 60 and intermediate the ends as necessary for supporting the pipe branches, for example, branch 28 as shown in FIG. 4. Attached to the top of the stabilizer 66 is a hanger 72 which permits convenient lifting off and reassembly of the radiant heating assemblies in a supported position on the flanges 56.

The reflector 62 is constructed to most efficiently reflect the infra-red radiation emitted from the pipe 28, and in the form shown the sections of the reflector laterally outwardly of the pipe extend at approximately 45° relative to the vertical, and the sections therebelow extend at approximately 30° relative to the vertical. In this manner, infra-red radiation is reflected downwardly from each surface to cover the entire area directly below the reflector. In addition, radiation can be reflected from one wall of the reflector to the other and then downwardly so as to provide radiation to areas laterally adjacent the lateral confines of the reflector element, which radiation overlaps with radiation from the other reflector units to provide radiation energy within substantially the entire booth area.

An important part of the present invention resides in the provision of a glass infra-red emitting panel 38 which extends the length of each radiant heating assembly 60. The glass is sold commercially under the trademark TEMPAX and is manufactured by Jenaer Glaswerk Schott & Gen., Mainz, West Germany. The glass is of borosilicate material, as opposed to ordinary alkali silicate glass, and can withstand constant use temperatures of 510° C. The thermal shock resistance according to DIN 52,325 is 250° C., and the thermal conductivity at 20° C. is 1.0 Kcal/m.h.grd. The glass withstands intense heat and thermal shock without expansion.

Other characteristics of the glass can be ascertained from the published Bulletin No. 8801/4e of the noted supplier.

The width of the glass panel 38 is such that the lateral edges thereof underlie the lateral edges 64 of the reflector 62, and the superposed edges of these numbers can be secured to one another in any suitable manner such as by bonding, or the like. The radiant energy emitted by the pipe 28, FIG. 4, is transmitted through the glass 28 to the booth area below, with the glass panel cooperating with the reflector 62 and the mounting means for the pipe 28 to form a sealed unit which can conveniently be lowered for support on the flanges 56 of the fabricated roof. It will be understood that the height and width of the radiant heating assemblies 60 will be correlated with the area of the booth and that the roof construction will be such as to provide openings of suitable width for receiving the radiant heating assemblies 60.

The glass panel 38 transmits the infra-red rays directed thereto from the radiant pipes and the reflector member 62. The positioning of the radiant heating assemblies 60 above the painting area and the sealed nature of the assemblies permits complete and uniform drying of all surfaces of workpieces positioned in the booth, for example an automobile, without subjecting the painter who is positioned inside the booth to excess heat and gaseous fumes. The radiant heating assemblies meet national and state health and safety regulations. A further, significant aspect of the invention is that due to the radiant heat energy being more efficient, substantially less fuel consumption per workpiece is expended. Preliminary testing has indicated that fuel savings of as much as 50% can be obtained through use of the invention.

Although only one radiant heating assembly has been shown in detail in the application drawings (FIG. 4) it will be understood that the other assemblies can be of similar or slightly modified construction. Each assembly importantly combines the radiant pipe, the reflector member, and the glass panel, all of which are constructed and arranged to form a sealed unit which can be conveniently positioned in openings provided therefor in the roof of the booth.

I claim:

1. A plurality of radiant heating assemblies adapted to be mounted on and extending substantially the entire length of a paint spray booth, each heating assembly adapted to be positioned on the roof of the booth and comprising a radiant pipe for emitting infra-red energy, a reflector member spaced at the sides of said radiant pipe and reflecting infra-red energy downwardly into the booth, and a glass panel below said radiant pipe and through which said infra-red energy is transmitted, means for supplying combustion gases to said pipe and exhausting spent gases therefrom, and heater means associated with at least two radiant pipes, said reflector member and said glass panel partially defining a sealed chamber in which said pipe is enclosed.

2. The combination of claim 1 wherein said pipe comprises three separate branches each of which forms part of a radiant heating assembly, said three branches being interconnected by a header.

3. The combination of claim 1 wherein said reflectors are formed with laterally outwardly extending flanges at the bottom end thereof, the flanges of said reflectors being joined to lateral edges of said glass panel and supported by lateral flanges of roof sections of the booth.

4. The combination of claim 1 wherein said radiant pipe branch is supported in the radiant heating assembly by means of a stabilizing member, pipe support members and a generally cylindrical pipe support section in which is disposed said radiant pipe branch.

5. The combination of claim 4 further including hanger means secured to said stabilizer and extending thereabove to facilitate positioning said radiant heating assembly on and lifting the same from the roof of the booth.

6. An infra-red heated paint spray booth comprising a booth in which the workpiece to be painted is positioned comprising a roof and side and end walls, a plurality of radiant heating assemblies extending substantially the entire length of the booth, each assembly being positioned on the roof of the booth and comprising a radiant pipe for emitting infra-red energy, a reflector member spaced at the sides of said radiant pipe and reflecting said infra-red energy downwardly into the booth, and a glass panel below said radiant pipe and through which said infra-red energy is transmitted, said reflector member and said glass panel partially defining a sealed chamber in which said pipe is enclosed, means for supplying combustion gases to said pipe and exhausting spent gases therefrom, heater means associated with at least two radiant pipes, and means for exhausting the fumes from the interior of said booth.

7. The booth of claim 6 wherein said pipe comprises three separate branches each of which forms part of a radiant heating assembly, said three branches being interconnected by a header.

8. The booth of claim 6 wherein said roof comprises a plurality of roof sections certain of which are spaced to provide transverse, longitudinally extending openings, each radiant heating assembly being positioned in said opening.

9. The booth of claim 8 wherein said roof sections which define said opening in which said radiant heating assemblies are positioned include laterally inwardly directed flanges, said reflector being formed with laterally outwardly extending flanges at the bottom end thereof, the flanges of said reflector being joined to the lateral edges of said glass panel and supported by said lateral flanges of said roof sections.

10. The booth of claim 6 wherein each radiant pipe branch is supported in the radiant heating assembly by means of a stabilizing member, pipe support members and a generally cylindrical pipe support section in which is disposed said radiant pipe branch.

11. The booth of claim 10 further including hanger means secured to said stabilizer and extending thereabove to facilitate positioning said radiant heating assembly on and lifting the same from said lateral edges of said roof sections.

12. The booth of claim 6 further including temperature control means in the interior of said booth for controlling the temperature therein, and lighting means positioned in said roof sections spaced from said radiant heating assemblies to provide lighting to the interior of said booth.

* * * * *